US010934708B2

(12) United States Patent
Forsland

(10) Patent No.: US 10,934,708 B2
(45) Date of Patent: Mar. 2, 2021

(54) RETRACTABLE ROOF STRUCTURE

(71) Applicant: Convertible Living LLC, River Falls, WI (US)

(72) Inventor: Kent Harry Forsland, River Falls, WI (US)

(73) Assignee: Convertible Living LLC, River Falls, WI (US)

( * ) Notice: Subject to any disclaimer, the term of this patent is extended or adjusted under 35 U.S.C. 154(b) by 0 days.

(21) Appl. No.: 16/515,126

(22) Filed: Jul. 18, 2019

(65) Prior Publication Data

US 2020/0024847 A1 Jan. 23, 2020

Related U.S. Application Data

(60) Provisional application No. 62/701,330, filed on Jul. 20, 2018.

(51) Int. Cl.
*E04B 7/16* (2006.01)
*E04B 1/343* (2006.01)

(52) U.S. Cl.
CPC ..... *E04B 7/166* (2013.01); *E04B 1/34357* (2013.01)

(58) Field of Classification Search
CPC ..... E04B 7/166; E04B 1/34357
See application file for complete search history.

(56) References Cited

U.S. PATENT DOCUMENTS 3,815,299 A * 6/1974 Sorensen ..... E04B 7/166 52/66
4,271,644 A * 6/1981 Rilliet ..... E04B 1/0046 52/67
4,426,744 A * 1/1984 Love ..... E04H 3/165 4/488
4,616,451 A * 10/1986 Glick ..... E04B 7/166 49/125
4,682,449 A * 7/1987 Berger ..... E04B 1/32 52/64
5,167,341 A * 12/1992 Morton ..... B61D 39/002 105/377.09
5,297,368 A * 3/1994 Okada ..... E04H 3/14 52/109
2003/0000154 A1* 1/2003 Ignazio ..... B60J 7/026 52/66
2011/0308173 A1* 12/2011 Forsland ..... E04B 1/0046 52/67
2013/0042541 A1* 2/2013 Forsland ..... E04B 1/34305 52/66
2014/0338270 A1* 11/2014 Forsland ..... E04B 7/16 52/66
2015/0013238 A1* 1/2015 Castel ..... E04F 10/10 52/67

* cited by examiner

*Primary Examiner* — Joshua K Ihezie
(74) *Attorney, Agent, or Firm* — Merchant & Gould P.C.

(57) ABSTRACT

A retractable roof structure includes first and second roof support structures separated by a span distance, with first and second roof sections supported on the first and second roof support structures. A load transfer structure is configured to transfer load from a frame of the second roof section downwardly through a frame and truss structure of the first roof section to the first and second roof support structures.

9 Claims, 4 Drawing Sheets

RETRACTABLE ROOF STRUCTURE

CROSS REFERENCE TO RELATED APPLICATION

This application claims the benefit of U.S. Provisional Application No. 62/701,330, Filed on Jul. 20, 2018, which is incorporated by reference in its entirety.

BACKGROUND

The present disclosure relates in general to the field of enclosures, and more particularly, to enclosures that include a selectively retractable roof.

Some enclosures for use outdoors are typically constructed to cover a predetermined area to protect the predetermined area from exposure to the elements. These enclosures suffer from a number of disadvantages. For instance, such enclosures are typically constructed so as to permanently cover the predetermined area. This may be undesirable where coverage for the predetermined area is only necessary or desired for a given period of time and where exposure to the elements may be desired on occasion. Further, such enclosures are generally not selectively configurable and are permanent in nature.

Some other such enclosures are configured for temporary use whereby they may be constructed to cover the predetermined area and taken down after use thereof. However, such enclosures are typically generally not capable of withstanding a wide variety of weather conditions such as wind, rain, and snow.

DETAILED DESCRIPTION

Figure 1:
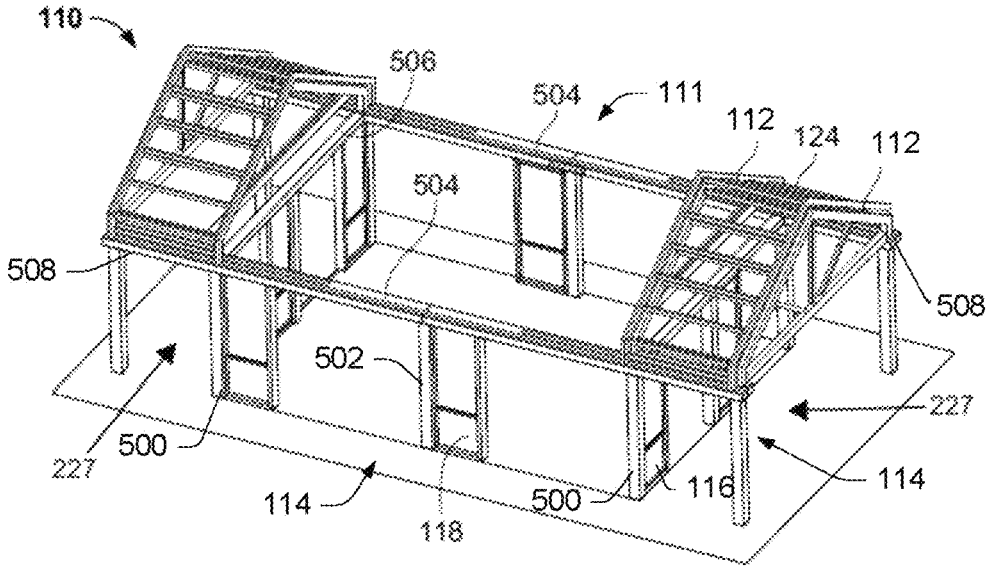
FIG. 1 is a perspective view of an example of an enclosure with a retractable roof structure in accordance with aspects of the present disclosure.

The present application incorporates by reference U.S. Pat. No. 9,915,062 to Forsland et al., issued Mar. 13, 2018, in its entirety. The incorporated patent discloses various examples of convertible enclosures, including enclosures having retractable roof systems.

FIGS. 1-4 illustrate an example of an enclosure 110 in accordance with aspects of the disclosure. The enclosure 110 includes a frame 111 for supporting the structure thereof. The enclosure 110 includes a pair of opposing ends 112 interconnected with one another by way of a pair of opposing sides 114 supported by the frame 111. The ends 112 include convertible end walls defined by a plurality of movable end wall panels 116 (i.e., door or wall sections) that can be used for ingress and egress between the interior of enclosure 110 and the surrounding area. Sides 114 include convertible side walls defined by side wall panels 118 (i.e., doors, wall sections or wall panels). Side wall panels 118 are movably coupled to a side wall track assembly 119. Side wall track assembly 119 includes an upper track 119*a* and a lower track 119*b* that extend along a length of the enclosure 110. Side wall panels 118 are secured between the upper track 119*a* and the lower track 119*b* to move therealong as is generally understood.

The frame 111 defines a fixed rectangular boundary or perimeter corresponding to the enclosable space of the enclosure 110 (i.e., the space defined inside the ends 112 and sides 114 of the enclosure). The frame 111 includes a plurality of fixed vertical posts that can be supported on footings such as Sonotubes, a floating cement slab, frost wall footings, an existing deck or patio or other suitable foundation. The vertical posts include corner posts 500 positioned at the corners of the enclosable space, and intermediate posts 502 positioned at the sides and ends of the enclosure adjacent mid-points between the corner posts. The frame 111 also includes horizontal beams supported on top of the vertical posts at roof level. The horizontal beams are preferably supported at a height above head level (e.g., at a height of at least 7 feet and preferably about 8 or 9 feet). The horizontal beams include side beams 504 that extend along the sides 114 of the enclosure and end beams 506 that extend along the ends 112 of the enclosure. The side beams 504 include end portions 508 that extend outwardly beyond the end walls and corner posts 500 of the enclosure 110. The end portions 508 are supported by further posts (e.g., supports 123) located outside the perimeter of the enclosable space of the enclosure.

The enclosure 110 further includes a roof 120 comprising a plurality of independently movable roof panels 124. The roof panels 124 comprise unitary structures configured to span the width of enclosure 110, and each roof panel 124 comprises a pair of sides that are pitched so as to meet at a medial position along the width of the enclosure 110 to define a peak 125. The roof panels 124 are positioned immediately laterally adjacent to one another so as to cooperate with one another to form a pitched roof 120. A lower portion of each of roof panels 124 is movably coupled to an upper track assembly 121. Upper track assembly 121 comprises a pair of laterally spaced tracks 121*a* and 121*b*, respectively in which each of the laterally spaced tracks 121*a* and 121*b* are supported by a pair of longitudinally spaced supports 123*a* and 123*b* and 123*c* and 123*d* (collectively supports 123), respectively. Specifically, the tracks are mounted on top of the horizontal side beams 504 so as to be elevated above head level. Supports 123 are positioned at points extending beyond each of end walls 112 of enclosure 110. Understandably, tracks 121 may extend beyond an end of only one of end walls 112 or both and supports 123 may be arranged correspondingly. In this manner, roof panels 124 are afforded a full range of motion along a full length of the frame of the enclosure 110. Further, when the roof panels 124 are in an open position as shown in FIG. 1, for instance, the interior of the enclosure 110 is entirely uncovered and an alternate covered so-called verandah area 227 is created at one or both ends of the structure. Additional horizontal or vertical frame members and wall surfaces may be provided around this verandah area as desired. Accordingly, as will be explained in further detail and is readily understandable, the roof panels 124 may be positioned such that the interior of enclosure 110 is completely uncovered. In other examples, the roof panels 124 may be positioned at one or both ends of the tracks 121 such that the roof panels are within the length dimension L when the roof is in the open position.

Figure 5:
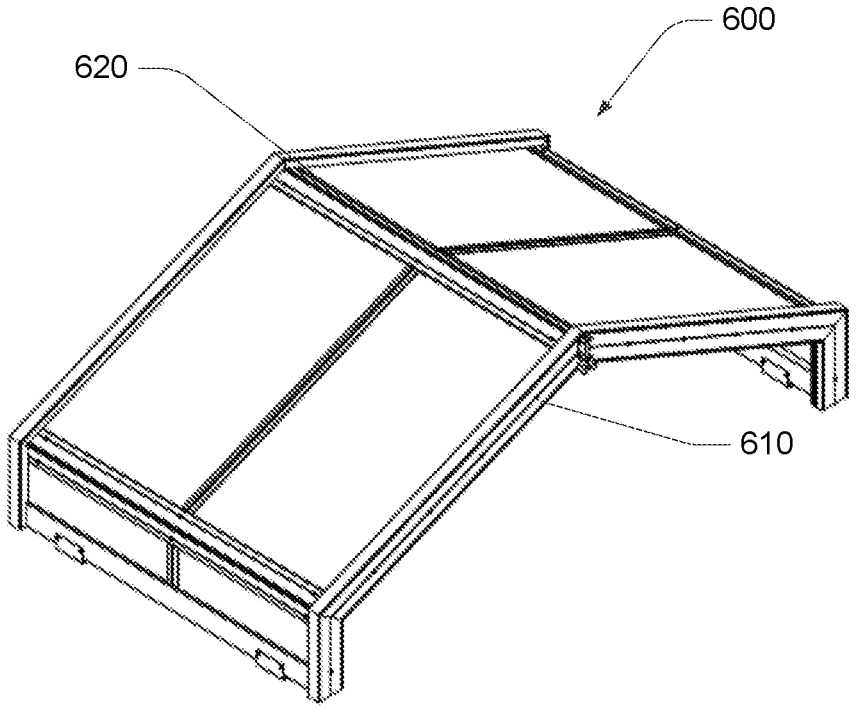
FIG. 5 is a perspective view illustrating an example roof panel of the enclosure of FIG. 1.
Figure 6:
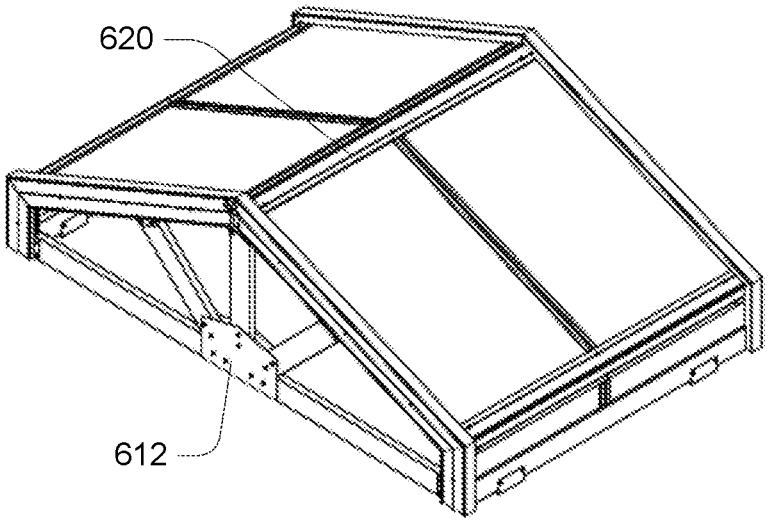
FIG. 6 is another perspective view illustrating further aspects of the example roof panel of FIG. 5.

The roof is formed by a plurality of roof sections that are slideable relative to one another. FIGS. 5-9 illustrate aspects of an example of the slideable roof sections. FIGS. 5 and 6 are perspective views from opposite sides illustrating an example of one roof section 600. The roof section has a length dimension that extends between opposite first and second ends of the roof section, and a width dimension that extends between opposite first and second sides of the roof section. The width dimension of the roof section is perpendicular relative to the length dimension of the roof section. The roof section is oriented such that the width dimension of the first roof section extends across the span distance as shown in FIGS. 1-4. The roof section has a frame 610 that supports panels of the roof section. The frame has a truss structure 612 positioned at the first end of the roof section, the truss structure of the roof section extending along the width of the roof section and being configured to reinforce the frame of the roof section across the span distance. The truss structure 612 at least partially obstructs the first end of the roof section.

Figure 2:
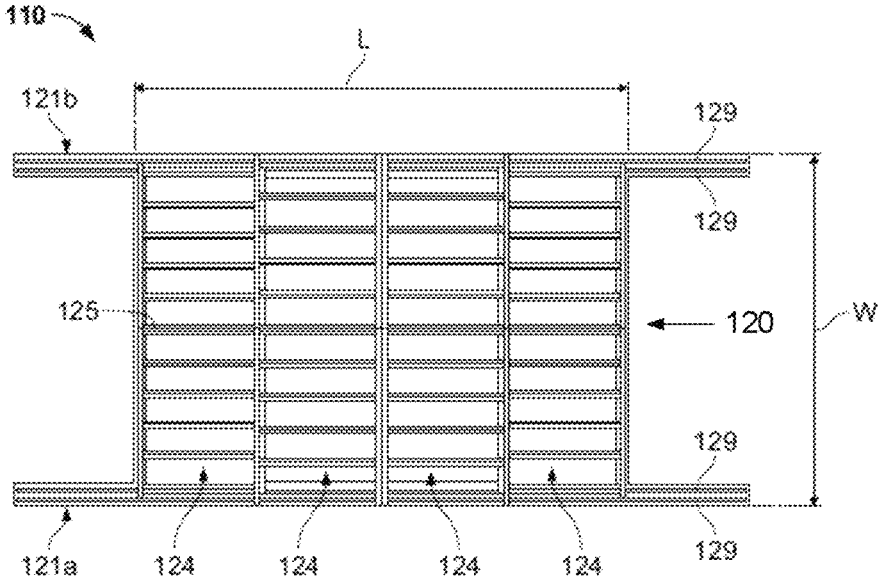
FIG. 2 is a top view illustrating further aspects of the example enclosure of FIG. 1.
Figure 3:
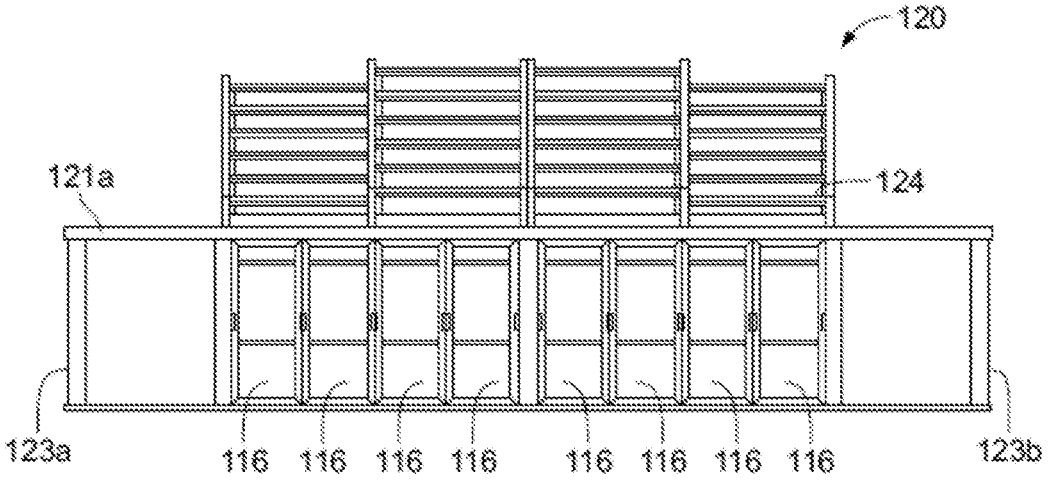
FIG. 3 is a side view illustrating further aspects of the example enclosure of FIG. 1.
Figure 4:
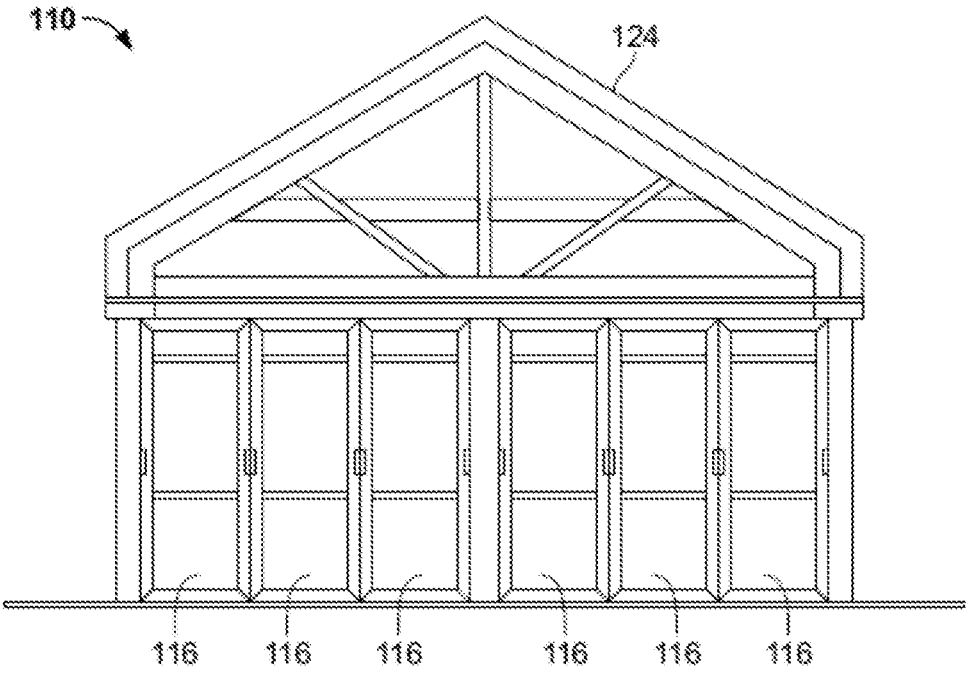
FIG. 4 is an end view illustrating further aspects of the example enclosure of FIG. 1.
Figure 7:
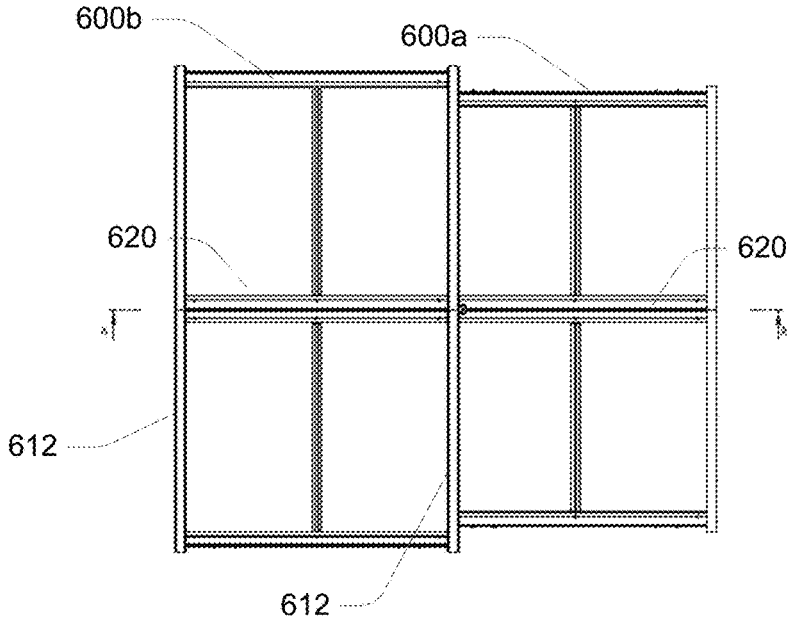
FIG. 7 is a top view illustrating an example of a configuration of two roof panels of the enclosure of FIG. 1.
Figure 8:
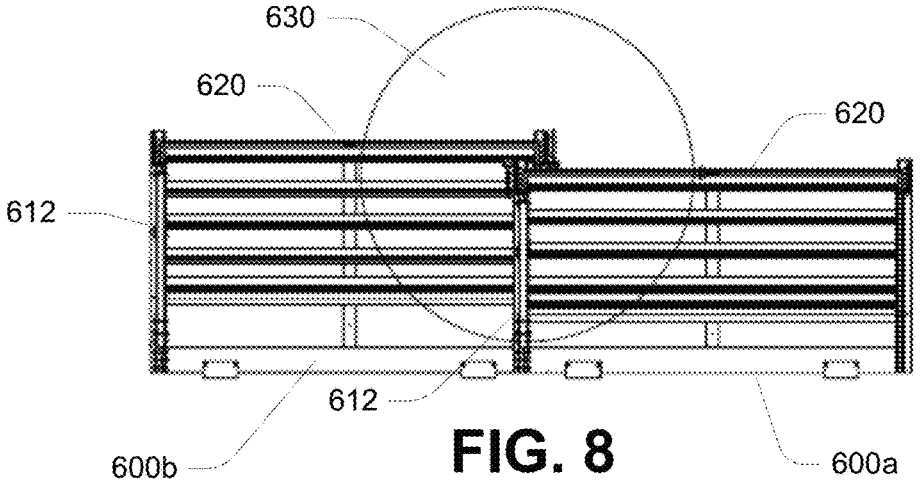
FIG. 8 is a side view illustrating further aspects of the example configuration of roof panels of FIG. 7.
Figure 9:
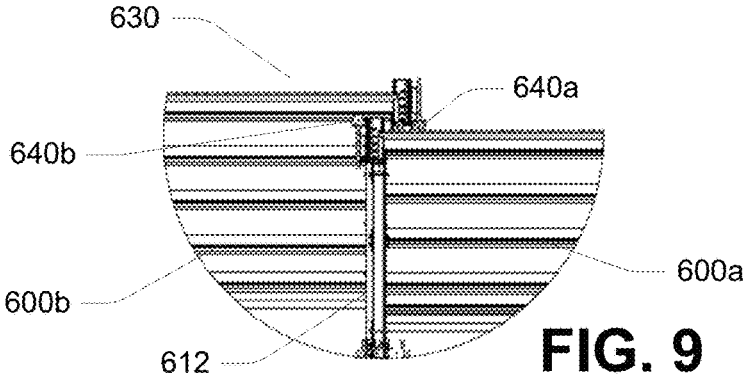
FIG. 9 is a close up view illustrating further aspects of the example configuration of roof panels of FIGS. 7 and 8.

FIGS. 7 and 8 illustrate first and second roof sections 600*a*, 600*b* positioned so as to span the width direction of the frame, such as in the example shown in FIG. 2. The first and second roof sections have similar constructions, but are sized such that one nests in the other. Thus, the second roof section 600*b* is configured to nest over the first roof section 600*a* with the first end of the first roof section 600*a* being received through the second end of the second roof section 600*b*, and the second roof section 600*b* being movable in the length dimension along the first and second support structures between extended and retracted positions relative to the first roof section 600*a*.

A load transfer structure 630 is configured for transferring load from the frame of the second roof section 600*b* downwardly through the frame and truss structure of the first roof section 600*a* to the first and second roof support structures.

In the illustrated example, the load transfer structure 600 includes a roller 640. The roller is vertically adjustable relative to the first or second roof sections to adjust a magnitude of load transferred from the second roof section to the first roof section.

As shown in FIGS. 5 and 6, each of the roof sections includes peaks 620 at an intermediate location along the span length that extend along the length dimensions. The load transfer structure transfers load from the second roof section 600*b* through the peak of the first roof section 600*a*.

The load transfer structure 630 includes a first load transfer element 640*a* attached to the second roof section 600*b* including a first roller 640*a* that mounts over and rides along the peak of the first roof section when the second roof section is moved between the extended and retracted positions, and wherein the load transfer structure includes a second load transfer element attached to the first roof section including a second roller 640*b* that mounts under and rides along the peak of the second roof section 600*b* when the second roof section is moved between the extended and retracted positions. The first roller is vertically adjustable relative to the second roof section and the second roller is vertically adjustable relative to the first roof section to adjust the amount of load transferred from the second roof section to the first roof section.

Further, in some examples, a third roof section is supported on the first and second roof support structures. The third roof section has a length dimension that extends between opposite first and second ends of the third roof section, the third roof section also has a width dimension that extends between opposite first and second sides of the third roof section. The width dimension of the third roof section is perpendicular relative the length dimension of the third roof section, and the third roof section is oriented such that the width dimension of the third roof section extends across the span distance. As with the first and second roof sections, the third roof section has a frame that supports panels of the third roof section. The frame of the third roof section has a truss structure positioned at the first end of the third roof section, and the truss structure of the third roof section extends along the width of the third roof section and is configured to reinforce the frame of the third roof section across the span distance. The truss structure of the third roof section at least partially obstructs the first end of the third roof section, and the third roof section is configured to nest over the second roof section with the first end of the second roof section received through the second end of the third roof section. The third roof section is movable in the length dimension along the first and second support structures between extended and retracted positions relative to the second roof section. A load transfer structure is provided for transferring load from the frame of the third roof section downwardly through the frame and truss structure of the second roof section to the first and second roof support structures.

It is specifically intended that the present invention not be limited to the embodiments and illustrations contained herein, but include modified forms of those embodiments including portions of the embodiments and combinations of elements of different embodiments as come within the scope of the following claim.

The invention claimed is:

1. A retractable roof structure comprising:

first and second roof support structures separated by a span distance;

a first roof section supported on the first and second roof support structures, the first roof section having a length dimension that extends between opposite first and second ends of the first roof section, the first roof section also having a width dimension that extends between opposite first and second sides of the first roof section, the width dimension of the first roof section being perpendicular relative the length dimension of the first roof section, the first roof section being oriented such that the width dimension of the first roof section extends across the span distance, the first roof section including a frame that supports panels of the first roof section, the frame of the first roof section including a truss structure positioned at the first end of the first roof section, the truss structure of the first roof section extending along the width of the first roof section and being configured to reinforce the frame of the first roof section across the span distance, the truss structure of the first roof section at least partially obstructing the first side of the first roof section;

a second roof section supported on the first and second roof support structures, the second roof section having a length dimension that extends between opposite first and second ends of the second roof section, the second roof section also having a width dimension that extends between opposite first and second sides of the second roof section, the width dimension of the second roof section being perpendicular relative the length dimension of the second roof section, the second roof section being oriented such that the width dimension of the second roof section extends across the span distance, the second roof section being movable in the length dimension along the first and second support structures between extended and retracted positions relative to the first roof section, the second roof section including a frame that supports panels of the second roof section, the frame of the second roof section including a truss structure positioned at the first end of the second roof section, the truss structure of the second roof section extending along the width of the second roof section and being configured to reinforce the frame of the second roof section across the span distance, the truss structure of the second roof section at least partially obstructing the first side of the second roof section, the second roof section being configured to nest over the first roof section with the first end of the first roof section being received through the second end of the second roof section such that the truss structure at the first end of the first roof section is positioned at the second end of the second roof section when the second roof section is in the extended position relative to the first section; and a load transfer structure for transferring load from the frame of the second roof section downwardly through the frame and truss structure of the first roof section to the first and second roof support structures, the load transfer structure including a roller that is vertically adjustable relative to the first or second roof sections to adjust a magnitude of load transferred from the second roof section to the first roof section.

2. The retractable roof structure of claim 1, wherein the first and second roof section include peaks at an intermediate location along the span distance that extend along the length dimensions.

3. The retractable roof structure of claim 2, wherein the load transfer structure transfers load from the second roof section through the peak of the first roof section.

4. The retractable roof structure of claim 2, wherein the load transfer structure includes a first load transfer element attached to the second roof section including a first roller that mounts over and rides along the peak of the first roof section when the second roof section is moved between the extended and retracted positions, and wherein the load transfer structure includes a second load transfer element attached to the first roof section including a second roller that mounts under and rides along the peak of the second roof section when the second roof section is moved between the extended and retracted positions.

5. The retractable roof structure of claim 4, wherein the first roller is vertically adjustable relative to the second roof section and the second roller is vertically adjustable relative to the first roof section to adjust the amount of load transferred from the second roof section to the first roof section.

6. A retractable roof structure comprising:

first and second roof support structures separated by a span distance;

a first roof section supported on the first and second roof support structures, the first roof section having a length dimension that extends between opposite first and second ends of the first roof section, the first roof section also having a width dimension that extends between opposite first and second sides of the first roof section, the width dimension of the first roof section being perpendicular relative the length dimension of the first roof section, the first roof section being oriented such that the width dimension of the first roof section extends across the span distance, the first roof section including a frame that supports panels of the first roof section, the frame of the first roof section including a truss structure positioned at the first end of the first roof section, the truss structure of the first roof section extending along the width of the first roof section and being configured to reinforce the frame of the first roof section across the span distance, the truss structure of the first roof section at least partially obstructing the first side of the first roof section, the first roof section including a peak at an intermediate location along the span distance that extends along the length dimension;

a second roof section supported on the first and second roof support structures, the second roof section having a length dimension that extends between opposite first and second ends of the second roof section, the second roof section also having a width dimension that extends between opposite first and second sides of the second roof section, the width dimension of the second roof section being perpendicular relative the length dimension of the second roof section, the second roof section being oriented such that the width dimension of the second roof section extends across the span distance, the second roof section being movable in the length dimension along the first and second support structures between extended and retracted positions relative to the first roof section, the second roof section including a frame that supports panels of the second roof section, the frame of the second roof section including a truss structure positioned at the first end of the second roof section, the truss structure of the second roof section extending along the width of the second roof section and being configured to reinforce the frame of the second roof section across the span distance, the truss structure of the second roof section at least partially obstructing the first side of the second roof section, the second roof section being configured to nest over the first roof section with the first end of the first roof section being received through the second end of the second roof section such that the truss structure at the first end of the first roof section is positioned at the second end of the second roof section when the second roof section is in the extended position relative to the first section, and the second roof section including a peak at an intermediate location along the span distance that extends along the length dimension; and a load transfer structure for transferring load from the frame of the second roof section downwardly through the frame and truss structure of the first roof section to the first and second roof support structures, the load structure including a first load transfer element attached to the second roof section including a first roller that mounts over and rides along the peak of the first roof section when the second roof section is moved between the extended and retracted positions, and wherein the load transfer structure includes a second load transfer element attached to the first roof section including a second roller that mounts under and rides along the peak of the second roof section when the second roof section is moved between the extended and retracted positions.

7. The retractable roof structure of claim 6, wherein at least one of the first roller or the second roller is vertically adjustable relative to the first or second roof sections to adjust a magnitude of load transferred from the second roof section to the first roof section.

8. The retractable roof structure of claim 6, wherein the load transfer structure transfers load from the second roof section through the peak of the first roof section.

9. The retractable roof structure of claim 8, wherein the first roller is vertically adjustable relative to the second roof section and the second roller is vertically adjustable relative to the first roof section to adjust the amount of load transferred from the second roof section to the first roof section.

* * * * *